US009869164B2

(12) United States Patent
Tolman et al.

(10) Patent No.: US 9,869,164 B2
(45) Date of Patent: Jan. 16, 2018

(54) INCLINED WELLBORE OPTIMIZATION FOR ARTIFICIAL LIFT APPLICATIONS

(71) Applicants: Randy C. Tolman, Spring, TX (US); Federico A. Tavarez, Pearland, TX (US)

(72) Inventors: Randy C. Tolman, Spring, TX (US); Federico A. Tavarez, Pearland, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 852 days.

(21) Appl. No.: 14/329,701

(22) Filed: Jul. 11, 2014

(65) Prior Publication Data

US 2015/0034325 A1 Feb. 5, 2015

Related U.S. Application Data

(60) Provisional application No. 61/862,406, filed on Aug. 5, 2013.

(51) Int. Cl.
*E21B 43/12* (2006.01)
*E21B 43/14* (2006.01)

(52) U.S. Cl.
CPC ..... *E21B 43/12* (2013.01); *E21B 43/14* (2013.01); *E21B 43/126* (2013.01)

(58) Field of Classification Search
CPC ..... E21B 43/14; E21B 43/12; E21B 43/24
See application file for complete search history.

(56) References Cited

U.S. PATENT DOCUMENTS

| | | | | |
|---|---|---|---|---|
| 4,878,539 | A | 11/1989 | Anders | |
| 5,154,588 | A | 10/1992 | Freet et al. | |
| 5,257,665 | A | 11/1993 | Watkins | |
| 5,271,725 | A | 12/1993 | Freet et al. | |
| 6,039,121 | A * | 3/2000 | Kisman | E21B 43/121 166/272.7 |
| 6,622,791 | B2 | 9/2003 | Kelley et al. | |
| 7,500,525 | B2 | 3/2009 | Brink | |
| 2008/0302523 | A1 * | 12/2008 | Wegener | E21B 23/01 166/63 |

(Continued)

FOREIGN PATENT DOCUMENTS

GB 2431182 B 9/2010

*Primary Examiner* — Giovanna C. Wright
*Assistant Examiner* — Kristyn A Hall
(74) *Attorney, Agent, or Firm* — ExxonMobil Upstream Research Company—Law Department

(57) ABSTRACT

A system for removing liquids from an inclined wellbore includes a plug member positioned within a heel section of the inclined wellbore, the plug member including an orifice therethrough; a first tubular member having a first end for providing fluid flow from the first portion of the wellbore to the second portion of the wellbore, a second end positioned at least partially within the second portion of the wellbore and providing fluid flow from the first portion of the wellbore to the second portion of the wellbore; a second tubular member positioned within the second portion of the wellbore, the second tubular member having a first end for receiving fluid from the second portion of the wellbore, the second end positioned adjacent the surface of the inclined wellbore; and a pump for pumping fluid from the second tubular member to the surface.

31 Claims, 1 Drawing Sheet

(56) References Cited

U.S. PATENT DOCUMENTS

| | | | |
|---|---|---|---|
| 2011/0209879 | A1 | 9/2011 | Quigley et al. |
| 2011/0247831 | A1 | 10/2011 | Smith et al. |
| 2012/0012333 | A1 | 1/2012 | Quigley et al. |

* cited by examiner

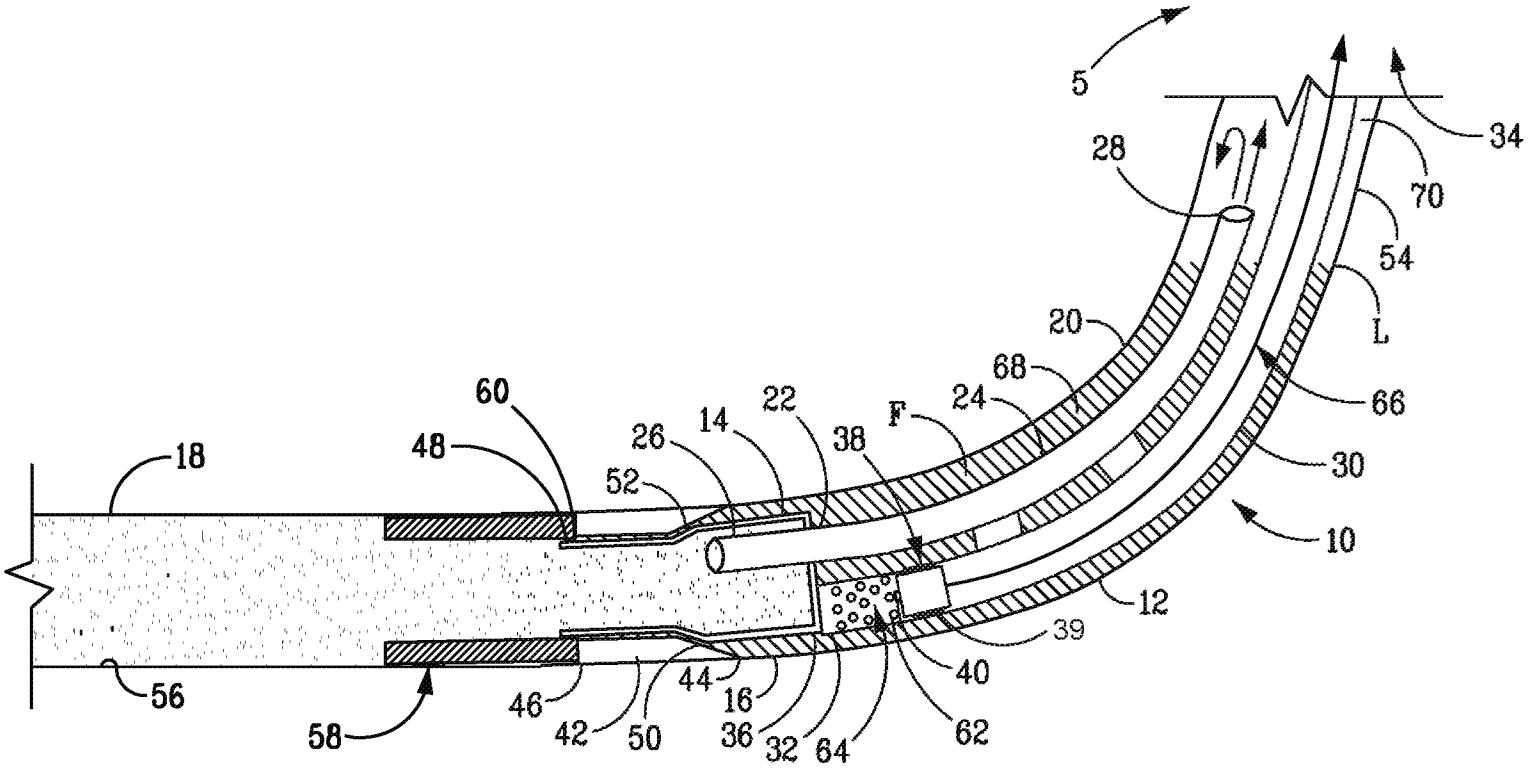
34
70
54
L
66
30
10
5
28
20
68
24
F
38
22
14
26
52
60
48
18
12
39
40
62
64
32
36
16
44
50
42
46
58
56

INCLINED WELLBORE OPTIMIZATION FOR ARTIFICIAL LIFT APPLICATIONS

CROSS REFERENCE TO RELATED APPLICATIONS

This application claims the benefit of U.S. Provisional No. 61/862,406, filed Aug. 5, 2013, the entirety of which is incorporated herein by reference for all purposes.

FIELD

The present disclosure is directed generally to increasing the efficiency of inclined wells. More particularly, artificial lift methods and systems are disclosed for use in gas producing inclined wells.

BACKGROUND

One major issue for inclined (horizontal) wells following the slowdown of natural flow, is the need to economically lift fluids from the well. This requires additional energy to be placed at the reservoir, to provide what the industry refers to as "artificial lift." For more than 100 years, the industry has focused on artificial lift applications for vertical wells, with little done for wells with significant deviations from vertical. With the advent of inclined wells, casing strings frequently run from vertical to horizontal in one continuous string of pipe. Significantly, the typical artificial methods employed in vertical well applications are ineffective, from an economic standpoint, in wells having high angles of deviation, particularly in the area of the heel of the well, where the hole and pipe transition from a vertical orientation to a horizontal orientation.

The most popular and economic artificial lift methods employ rod and tubing pumps, which require relatively straight holes. Some variation in angle is mitigated with rod guides, rollers, and other devices, in order to minimize drag and reduce wear on the rods, couplings, and tubing. The next most popular methods employ electric submersible pumps (ESP). These methods involve running an electric motor down the well and direct-coupling the motor to a pump. This style of pump typically requires a constant run (i.e., no multiple starts and stops during a day) in order to be economically feasible. These pumps are designed to move high volumes of fluid (>100 bpd) and typically cannot handle high gas/oil ratios. However, they do work well around highly deviated wellbores. Other forms of artificial lift have their own advantages and disadvantages depending on the application. Each method is significantly benefited, economically, if it can have a reservoir fluid with little or no gas entering the pump in an efficient and effective manner.

Therefore, what is needed is an improved and cost-effective artificial lift method and system for use in inclined wells.

SUMMARY

In one aspect, provided is a system for removing liquids from an inclined wellbore, the inclined wellbore including a first portion and a second portion. The system includes a plug member positioned within a heel section of the inclined wellbore and hydraulically isolating the first portion from the second portion, the plug member including an orifice therethrough providing fluid flow from the first portion of the wellbore to the second portion of the wellbore; a first tubular member having a first end and a second end, the first end providing fluid flow from the first portion of the wellbore to the second portion of the wellbore through the orifice of the plug member, the second end positioned at least partially within the second portion of the wellbore and providing fluid flow from within the first tubular member from the first portion of the wellbore to the second portion of the wellbore; a second tubular member positioned within the second portion of the wellbore, the second tubular member having a first end and a second end, the first end receiving fluid from the second portion of the wellbore, positioned adjacent a first end of the plug and the second end positioned adjacent the surface of the inclined wellbore; and a pump having a pump intake, the pump intake receiving fluid from the second portion of the wellbore at a fluid level within the wellbore that is between the plug and the second end of the first tubular member for pumping fluid from the second tubular member to the surface.

In some embodiments, the pump is positioned within the second tubular member proximate the first end of the second tubular member.

In some embodiments, the second end of the first tubular member is positioned above a liquid level existing above the plug member, the first end located at an elevation below the second end.

In some embodiments, the system further includes a sleeve positioned within the heel section of the inclined wellbore, the sleeve having a first end and a second end, the first end adapted to receive one end of the plug member.

In some embodiments, the inclined wellbore includes a casing and the system further includes swellable material positioned to prevent the egress of liquids between an inner surface of the casing and an outer surface of the plug member.

In some embodiments, the first end of the sleeve has a chamfered sealing surface and the plug member is swaged to mate with the chamfered sealing surface to effect a seal.

In some embodiments, the system further includes a particulate filter positioned adjacent the first end of the second tubular member.

In some embodiments, the first end of the second tubular member is perforated for the intake of liquids.

In some embodiments, the pump is an electric submersible pump.

In some embodiments, an electric cable for powering the electric submersible pump is passed from the surface of the inclined wellbore through the second tubular to the electric submersible pump.

In some embodiments, the system further includes a seat within the second tubular configured to permit the pumping means to be stabbed in and removed.

In some embodiments, liquids are separated from gas adjacent the second end of the first tubular for transporting through the second tubular to the surface of the inclined wellbore.

In some embodiments, the inclined well is in fluid communication with a subterranean reservoir that produces sufficient gas to foul, interrupt, or cause significant efficiency loss of the pump.

In some embodiments, the subterranean reservoir is gas-dominated.

In another aspect, provided is a method for removing liquids from an inclined wellbore, the inclined wellbore including a first portion and a second portion. The method includes positioning a plug member within a heel section of the inclined wellbore, the plug member having an orifice therethrough; placing a first tubular member having a first end and a second end, the first end providing fluid flow from the first portion of the wellbore to the second portion of the wellbore through the orifice of the plug member, the second end positioned at least partially within the second portion of the wellbore and providing fluid flow from within the first tubular member from the first portion of the wellbore to the second portion of the wellbore; placing a second tubular member within the second portion of the wellbore, the second tubular member having a first end and a second end, the first end receiving fluid from the second portion of the wellbore, positioned adjacent a first end of the plug and the second end positioned adjacent the surface of the inclined wellbore; installing a pump having a pump intake, the pump intake positioned to receive fluid from the second portion of the wellbore at a fluid level within the wellbore that is between the plug and the second end of the first tubular member for pumping fluid from the second tubular member to the surface within the second tubular member proximate the first end of the second tubular member; and transporting liquids from the inclined wellbore through the second tubular member.

In some embodiments, the method further includes the steps of separating liquids from gas adjacent the second end of the first tubular for transporting through the second tubular to the surface of the inclined wellbore.

In some embodiments, the inclined wellbore includes a casing and the method further includes the step of placing a swellable material to substantially prevent the egress of liquids between an inner surface of the casing and an outer surface of the plug member.

In some embodiments, the method further includes the step of placing a particulate filter adjacent the first end of the second tubular member.

In some embodiments, the first end of the second tubular member is perforated for the intake of liquids.

In some embodiments, the pump is an electric submersible pump.

In some embodiments, the method further includes the step of installing an electric cable from the surface of the inclined wellbore through the second tubular member for powering the electric submersible pump.

In some embodiments, the method further includes the step of installing a seat within the second tubular to permit the pump to be stabbed in and removed.

In some embodiments, the method further includes the step of installing a sleeve within the heel section of the inclined wellbore, the sleeve having a first end and a second end, the first end adapted to receive one end of the plug member.

In some embodiments, wherein the first end of the sleeve has a chamfered sealing surface and the plug member is swaged to mate with the chamfered sealing surface to effect a seal.

In some embodiments the inclined well is in fluid communication with a subterranean reservoir that produces sufficient gas to foul, interrupt, or cause significant efficiency loss of the pump.

In some embodiments, the subterranean reservoir is gas-dominated.

In yet another aspect, provided is an artificial lift kit for removing liquids from a inclined wellbore, the inclined wellbore including a first portion and a second portion. The artificial lift kit includes a plug member for positioning within a heel section of the inclined wellbore to hydraulically isolate the first portion from the second portion, the plug member including an orifice therethrough for providing fluid flow from the first portion of the wellbore to the second portion of the wellbore; a first tubular member having a first end and a second end, the first end for providing fluid flow from the first portion of the wellbore to the second portion of the wellbore through the orifice of the plug member, the second end for positioning at least partially within the second portion of the wellbore and providing fluid flow from within the first tubular member from the first portion of the wellbore to the second portion of the wellbore; a second tubular member for positioning within the second portion of the wellbore, the second tubular member having a first end and a second end, the first end for receiving fluid from the second portion of the wellbore when and the second end for positioning adjacent the surface of the inclined wellbore; and a pump having a pump intake, the pump intake for receiving fluid from the second portion of the wellbore at a fluid level within the wellbore that is between the plug and the second end of the first tubular member for pumping fluid from the second tubular member to the surface.

In some embodiments, the artificial lift kit further includes a sleeve for positioning within the heel section of the inclined wellbore, the sleeve having a first end and a second end, the first end adapted to receive one end of the plug member.

In some embodiments, the artificial lift kit further includes a swellable material for positioning to substantially prevent the egress of liquids between an inner surface of a casing and an outer surface of the plug member.

In some embodiments, the first end of the sleeve has a chamfered sealing surface and the plug member is swaged to mate with the chamfered sealing surface to effect a seal.

In some embodiments, the artificial lift kit further includes a particulate filter for positioning adjacent the first end of the second tubular member.

In some embodiments, the first end of the second tubular member is perforated for the intake of liquids.

In some embodiments, the pump is an electric submersible pump.

In some embodiments, the artificial lift kit further includes a seat for placement within the second tubular configured to permit the pumping means to be stabbed in and removed.

BRIEF DESCRIPTION OF THE DRAWINGS

The FIGURE presents a schematic view of an illustrative, non-exclusive example of a system for removing liquids from an inclined wellbore, according to the present disclosure.

DETAILED DESCRIPTION

The FIGURE provides an illustrative, non-exclusive example of a downhole gas/liquid separation and pumping system having utility in connection with other wellbore-related methods and systems, according to the present disclosure of systems, and/or apparatus, and/or assemblies that may include, be associated with, be operatively attached to, and/or utilize such downhole gas/liquid separation and pumping systems. In the FIGURE, like numerals denote like, or similar, structures and/or features; and each of the illustrated structures and/or features may not be discussed in detail herein with reference to the FIGURE. Similarly, each structure and/or feature may not be explicitly labeled in the FIGURE; and any structure and/or feature that is discussed herein with reference to the FIGURE may be utilized with any other structure and/or feature without departing from the scope of the present disclosure.

In general, structures and/or features that are, or are likely to be, included in a given embodiment are indicated in solid lines in the FIGURE, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

By use of the term "vertical," "vertically" or "vertical section," when referring to a well, a wellbore, tubing or tubular member, or section or portion thereof, is meant that such well, wellbore, tubing or tubular member, or section thereof, is positioned or is to be positioned, so as to be substantially normal to a plane formed at the ground or surface level of the well or wellbore.

By use of the term "inclined" or "inclined section," when referring to a well, a wellbore, tubing or tubular member, or section or portion thereof, is meant that such well, wellbore, tubing or tubular member, or section thereof, is positioned, or is to be positioned, so as to deviate in direction from vertical and encompasses a well, a wellbore, tubing or tubular member, or section or portion thereof, extending in horizontally or in a horizontal direction.

By use of the term "horizontal," "horizontally" or "horizontal section," when referring to a well, a wellbore, tubing or tubular member, or section or portion thereof, is meant that such well, wellbore, tubing or tubular member, or section thereof, is positioned or is to be positioned, so as to travel along a plane substantially parallel to a plane formed tangentially at the ground or surface level of the well or wellbore.

By use of the term "heel," when referring to a well, a wellbore, tubing or tubular member, or section or portion thereof, is meant the first point or section in a inclined or horizontal well trajectory where the inclination deviates from vertical. An intermediate casing may be set at this landing point to isolate the pay zone.

The FIGURE presents a schematic view of an illustrative, non-exclusive example of a system 10 for removing liquids from an inclined wellbore 12, according to the present disclosure. System 10 includes a plug member 14 positioned within a heel section 16 of the inclined wellbore 12. As may be appreciated from the FIGURE, the placement of plug member 14 within heel section 16 serves to hydraulically isolate wellbore 12 into a first portion 18 and a second portion 20. Plug member 14 includes an orifice 22 therethrough, to enable fluid flow from first portion 18 of wellbore 12 to second portion 20 of wellbore 12.

As shown in the FIGURE, system 10 includes a first tubular member 24. First tubular member 24 has a first end 26 and a second end 28, first end 26 providing fluid flow from first portion 18 of wellbore 12 to second portion 20 of wellbore 12 through orifice 22 of plug member 14. Second end 28 of first tubular member 24 is positioned at least partially within second portion 20 of wellbore 12 and provides fluid flow from within the first tubular member from first portion 18 of wellbore 12 to second portion 20 of wellbore 12.

System 10 also includes a second tubular member 30 positioned within second portion 20 of wellbore 12. Second tubular member 30 has a first end 32 and a second end 34, first end 32 of second tubular member 30 for receiving fluid from second portion 20 of wellbore 12 and positioned adjacent a first end 36 of plug member 14. As may be envisioned, second end 34 can be positioned adjacent the surface (not shown) of inclined wellbore 12.

As shown in the FIGURE, a pump 38 having a pump intake 40 is provided for receiving fluid F from second portion 20 of wellbore 12 at a fluid level L within wellbore 12. Fluid level L, as shown, lies between plug member 14 and second end 28 of first tubular member 24. As may be appreciated, pump 38 pumps fluid F from second tubular member 30 to the surface S. In some embodiments, pump 38 may be positioned within second tubular member 30 proximate first end 32 of second tubular member 30. Optionally, in some embodiments, a seat (not shown) is provided within second tubular 30 and configured to permit pump 38 to be stabbed in and removed.

In some embodiments, pump 38 may be an electric submersible pump (ESP). As those skilled in the art recognize, an ESP is a device having a hermetically sealed motor close-coupled to a pump body. The assembly is submerged in the fluid to be pumped. An ESP tends to prevent pump cavitation, a problem associated with a high elevation difference between pump and the fluid surface. Submersible pumps push fluid to the surface, as opposed to jet pumps, which pull fluids. Well fluids enter the pump through an intake screen and are lifted by the pump stages.

ESP systems consist of both surface components, housed in the production facility, and sub-surface components, found in the well hole. Surface components include the motor controller, often a variable speed controller, surface cables and transformers. Subsurface components typically include the pump, motor, seal and cables. An ESP is typically a multi-stage unit, with the number of stages being determined by the operating requirements. Each stage consists of a driven impeller and a diffuser which directs flow to the next stage of the pump. Typically, pumps come in diameters from 90 mm (3.5 inches) to 254 mm (10 inches) and vary between 1 meter (3 ft) and 8.7 meters (29 ft) in length. The motor used to drive the pump is often a three phase induction motor, with a power rating in the range 7.5 kW to 560 kW (at 60 Hz). Suitable ESPs are available from BJM Pumps, LLC of Old Saybrook, Conn., Stancor Pumps Inc. of Monroe, Conn., and Cormorant Engineering of New Waverly, Tex.

When an ESP is employed, an electric cable 66 for powering the ESP may be provided that passes from the surface S of inclined wellbore 12 through second tubular 30 to the ESP. Optionally, a coiled tubing umbilical may be provided that allows for both the piping and electric cable to be deployed within a single conventional coiled tubing unit.

In some embodiments, second end 26 of first tubular member 24 is positioned above a liquid level L, which may exist above plug member 14. In this configuration, first end 26 is located at an elevation below second end 28. As may be appreciated by those skilled in the art, this arrangement serves to create a separator for an initial processing of fluids down hole, advantageously separating the fluids (liquid and gas) into a more efficient state for retrieval to surface S using artificial lift means.

In some embodiments, system 10 includes a sleeve 42 positioned within heel section 16 of inclined wellbore 12. As shown in the FIGURE, sleeve 42 has a first end 44 and a second end 46, first end 44 adapted to receive one end 48 of plug member 14. In some embodiments, first end 44 of sleeve 42 may be provided with a chamfered sealing surface 50 and the plug member 14 provided with a swaged portion 52 to mate with chamfered sealing surface 50 to at least substantially effect a seal.

As may be appreciated by those skilled in the art, inclined wellbore 12 may include a casing 54 having an inner surface 56. In some embodiments, system 10 may further include a swellable material 58, swellable material 58 positioned to prevent the egress of liquids between inner surface 56 of casing 54 and an outer surface 60 of plug member 14.

In some embodiments, particulate filter 62 may be positioned adjacent first end 32 of second tubular member 30. In some embodiments, first end 32 of second tubular member 30 is provided with perforations 64 for the intake of liquids.

As may be appreciated, system 10 can greatly benefit a wide variety of wells. System 10 may be employed in cases where the inclined wellbore is well in fluid communication with a subterranean reservoir that produces sufficient gas to foul, interrupt, or cause significant efficiency losses for an artificial lift pump, in particular, those subterranean reservoirs that are gas-dominated. This is due, at least in part, to the fact that liquids may be separated from gas adjacent second end 28 of first tubular 24 for transporting through second tubular 30 to the surface S of inclined wellbore 12.

Still referring to the FIGURE, as may be appreciated, the region 68, which is external to first tubular member 24 and second tubular 30 and located above plug member 14, serves as a sump to separate the produced liquid and gas by gravity, and permits only liquids to enter the pump 38. Gas flows up to the surface in the annular region 70.

Also provided herein is a method for removing liquids from an inclined wellbore, the inclined wellbore including a first portion and a second portion. The method includes positioning a plug member within a heel section of the inclined wellbore, the plug member having an orifice therethrough; placing a first tubular member having a first end and a second end, the first end providing fluid flow from the first portion of the wellbore to the second portion of the wellbore through the orifice of the plug member, the second end positioned at least partially within the second portion of the wellbore and providing fluid flow from within the first tubular member from the first portion of the wellbore to the second portion of the wellbore; a second tubular member positioned within the second portion of the wellbore, the second tubular member having a first end and a second end, the first end receiving fluid from the second portion of the wellbore, positioned adjacent a first end of the plug and the second end positioned adjacent the surface of the inclined wellbore; installing a pump having a pump intake, the pump intake positioned to receive fluid from the second portion of the wellbore at a fluid level within the wellbore that is between the plug and the second end of the first tubular member for pumping fluid from the second tubular member to the surface within the second tubular member proximate the first end of the second tubular member; and transporting liquids from the inclined wellbore through the second tubular member. In some embodiments, the pump is an electric submersible pump.

In some embodiments, the method further includes the steps of separating liquids from gas adjacent the second end of the first tubular for transporting through the second tubular to the surface of the inclined wellbore.

In some embodiments the inclined well is in fluid communication with a subterranean reservoir that produces sufficient gas to foul, interrupt, or cause significant pump efficiency losses. In some embodiments, the subterranean reservoir is gas-dominated.

Also provided herein is an artificial lift kit for removing liquids from an inclined wellbore, the inclined wellbore including a first portion and a second portion. The artificial lift kit includes a plug member for positioning within a heel section of the inclined wellbore to hydraulically isolate the first portion from the second portion, the plug member including an orifice therethrough for providing fluid flow from the first portion of the wellbore to the second portion of the wellbore; a first tubular member having a first end and a second end, the first end for providing fluid flow from the first portion of the wellbore to the second portion of the wellbore through the orifice of the plug member, the second end for positioning at least partially within the second portion of the wellbore and providing fluid flow from within the first tubular member from the first portion of the wellbore to the second portion of the wellbore; a second tubular member for positioning within the second portion of the wellbore, the second tubular member having a first end and a second end, the first end for receiving fluid from the second portion of the wellbore and the second end for positioning adjacent the surface of the inclined wellbore; and a pump having a pump intake, the pump intake for receiving fluid from the second portion of the wellbore at a fluid level within the wellbore that is between the plug and the second end of the first tubular member for pumping fluid from the second tubular member to the surface. In some embodiments, the pump is an electric submersible pump.

In some embodiments, the artificial lift kit further includes a sleeve for positioning within the heel section of the inclined wellbore, the sleeve having a first end and a second end, the first end adapted to receive one end of the plug member. In some embodiments, the first end of the sleeve has a chamfered sealing surface and the plug member is swaged to mate with the chamfered sealing surface to effect a seal.

In some embodiments, the artificial lift kit further includes a swellable material for positioning to substantially prevent the egress of liquids between an inner surface of a casing and an outer surface of the plug member. In some embodiments, the artificial lift kit further includes a particulate filter for positioning adjacent the first end of the second tubular member.

In some embodiments, the first end of the second tubular member is perforated for the intake of liquids. In some embodiments, the artificial lift kit further includes a seat for placement within the second tubular configured to permit the pump to be stabbed in and removed.

The systems, methods and kits disclosed herein may provide a significant means for reducing operating costs for artificial lift of gas-dominated inclined wells. The systems, methods and kits disclosed herein take advantage of the inclined angle of the wellbore and, as mentioned above, effectively establishing a separator for initial processing of fluids down hole.

The systems, methods and kits disclosed herein permit low potential flowing bottom hole pressures, while enabling an efficient location for the pump to draw liquids from. As may be appreciated, gas, having the lowest molecular weight, is concentrated in the annular region and allowed to flow to surface under its own pressure. Liquids, on the other hand, are kept from this path where, if allowed to accumulate, would create back pressure on the formation and restrict flow.

As may be appreciated, in operation, liquids are separated from gas by gravity and the liquid falls back into the sump. The sump is located along the horizontal transition axis of the wellbore. Unique to the systems, methods and kits disclosed herein is the significant volume that can be accumulated within an inclined wellbore, compared to vertical applications. As may be appreciated, the horizontal length of the sump is not limited. In some applications, the sump can be hundreds of feet in length, or at least 500 feet in length, or at least 250 feet in length, or at least 100 feet in length, depending on design requirements. Additionally, high volume pumps would benefit even more from the systems, methods and kits disclosed herein than low volume pumps, having a larger sump to draw from.

In some embodiments, the systems, methods and kits disclosed herein may employ a long section of screen for filtering out solids before entering the suction inlet of the pump. To prolong screen life, longer and higher volume sumps allow for the separation of solids to the bottom of the pipe prior to arriving at the screen. Screens can be removed during equipment maintenance trips and can either be replaced, repaired, or cleaned.

In some embodiments, the systems, methods and kits disclosed herein may be configured to provide a "plug and play" artificial lift pumping system, which may be placed into and taken out of the well without killing the well through the use of heavy fluids. As those skilled in the art plainly recognize, heavy fluids are used to control flow and gas break at the surface. However, this has become recognized as both a safety and an environmental issue. By using a continuous pipe, such as coil tubing for deployment, tools can be removed from the well under pressure, without leakage of wellbore fluids.

In some embodiments, the systems, methods and kits disclosed herein may be designed to permit maintenance and installation to be completed within a one-day work window, in order to avoid additional charges for overtime or other economic encumbrances. The systems, methods and kits disclosed herein may be used in conjunction with best available technologies for reading bottom-hole pressures, measuring pump conditions, and overall readiness of operation. All combined, the systems, methods and kits disclosed herein may serve to reduce overall operational expenses, thus enabling more reserve recovery from an individual well and field of operation.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A system for removing liquids from an inclined wellbore, the inclined wellbore including a first portion and a second portion, the system comprising, (a) a plug member positioned within a heel section of the inclined wellbore and hydraulically isolating the first portion from the second portion, the plug member including an orifice therethrough providing fluid flow from the first portion of the wellbore to the second portion of the wellbore;

(b) a first tubular member having a first end and a second end, the first end providing fluid flow from the first portion of the wellbore to the second portion of the wellbore through the orifice of the plug member, the second end positioned at least partially within the second portion of the wellbore and providing fluid flow from within the first tubular member from the first portion of the wellbore to the second portion of the wellbore;

(c) a second tubular member positioned within the second portion of the wellbore, the second tubular member having a first end and a second end, the first end receiving fluid from the second portion of the wellbore, positioned adjacent a first end of the plug member and the second end positioned adjacent the surface of the inclined wellbore;

(d) a pump having a pump intake, the pump intake receiving fluid from the second portion of the wellbore at a fluid level within the wellbore that is between the plug member and the second end of the first tubular member for pumping fluid from the second tubular member to the surface; and (e) a sleeve positioned within the heel section of the inclined wellbore, the sleeve adapted to receive the plug member.

2. The system of claim 1, wherein the pump is positioned within the second tubular member proximate the first end of the second tubular member.

3. The system of claim 1, wherein the second end of the first tubular member is positioned above a liquid level existing above the plug member, the first end located at an elevation below the second end.

4. The system of claim 1, wherein the inclined wellbore includes a casing and the system further includes swellable material positioned to prevent the egress of liquids between an inner surface of the casing and an outer surface of the plug member.

5. The system of claim 4, wherein the sleeve has a chamfered sealing surface and the plug member is swaged to mate with the chamfered sealing surface to effect a seal.

6. The system of claim 1, further comprising a particulate filter positioned adjacent the first end of the second tubular member.

7. The system of claim 1, wherein the first end of the second tubular member is perforated for the intake of liquids.

8. The system of claim 1, wherein the pump is an electric submersible pump.

9. The system of claim 8, wherein an electric cable for powering the electric submersible pump passes from the surface of the inclined wellbore through the second tubular to the electric submersible pump.

10. The system of claim 1, further comprising a seat within the second tubular configured to permit the pump to be stabbed in and removed.

11. The system of claim 1, wherein liquids are separated from gas adjacent the second end of the first tubular for transporting through the second tubular to the surface of the inclined wellbore.

12. The system of claim 1, wherein the inclined well is in fluid communication with a subterranean reservoir that produces sufficient gas to foul, interrupt, or cause significant efficiency loss in artificial lift pumps.

13. The system of claim 12, wherein the subterranean reservoir is gas-dominated.

14. A method for removing liquids from an inclined wellbore, the inclined wellbore including a first portion and a second portion, the method comprising, (a) positioning a plug member within a heel section of the inclined wellbore, the plug member having an orifice therethrough;

(b) placing a first tubular member having a first end and a second end, the first end providing fluid flow from the first portion of the wellbore to the second portion of the wellbore through the orifice of the plug member, the second end positioned at least partially within the second portion of the wellbore and providing fluid flow from within the first tubular member from the first portion of the wellbore to the second portion of the wellbore;

(c) placing a second tubular member within the second portion of the wellbore, the second tubular member having a first end and a second end, the first end receiving fluid from the second portion of the wellbore, positioned adjacent a first end of the plug member and the second end positioned adjacent the surface of the inclined wellbore;

(d) installing a pump having a pump intake, the pump intake positioned to receive fluid from the second portion of the wellbore at a fluid level within the wellbore that is between the plug member and the second end of the first tubular member for pumping fluid from the second tubular member to the surface within the second tubular member proximate the first end of the second tubular member;

(e) transporting liquids from the inclined wellbore through the second tubular member; and (f) providing a sleeve positioned within the heel section of the inclined wellbore for the sleeve to receive the plug member.

15. The method of claim 14, further comprising the steps of separating liquids from gas adjacent the second end of the first tubular for transporting through the second tubular to the surface of the inclined wellbore.

16. The method of claim 15, wherein the inclined wellbore includes a casing and the method further comprises the step of placing a swellable material to substantially prevent the egress of liquids between an inner surface of the casing and an outer surface of the plug member.

17. The method of claim 14, further comprising the step of placing a particulate filter adjacent the first end of the second tubular member.

18. The method of claim 14, wherein the first end of the second tubular member is perforated for the intake of liquids.

19. The method of claim 14, wherein the pump is an electric submersible pump.

20. The method of claim 19, further comprising the step of installing an electric cable from the surface of the inclined wellbore through the second tubular member for powering the electric submersible pump.

21. The method of claim 14, further comprising the step of installing a seat within the second tubular to permit the pump to be stabbed in and removed.

22. The method of claim 14, wherein the sleeve has a chamfered sealing surface and the plug member is swaged to mate with the chamfered sealing surface to effect a seal.

23. The method of claim 14, wherein the inclined well is in fluid communication with a subterranean reservoir that produces sufficient gas to foul, interrupt, or cause significant efficiency loss in artificial lift pumps.

24. The method of claim 23, wherein the subterranean reservoir is gas-dominated.

25. An artificial lift kit for removing liquids from a inclined wellbore, the inclined wellbore including a first portion and a second portion, the kit comprising, (a) a plug member for positioning within a heel section of the inclined wellbore to hydraulically isolate the first portion from the second portion, the plug member including an orifice therethrough for providing fluid flow from the first portion of the wellbore to the second portion of the wellbore;

(b) a first tubular member having a first end and a second end, the first end for providing fluid flow from the first portion of the wellbore to the second portion of the wellbore through the orifice of the plug member, the second end for positioning at least partially within the second portion of the wellbore and providing fluid flow from within the first tubular member from the first portion of the wellbore to the second portion of the wellbore;

(c) a second tubular member for positioning within the second portion of the wellbore, the second tubular member having a first end and a second end, the first end for receiving fluid from the second portion of the wellbore when and the second end for positioning adjacent the surface of the inclined wellbore;

(d) a pump having a pump intake, the pump intake for receiving fluid from the second portion of the wellbore at a fluid level within the wellbore that is between the plug member and the second end of the first tubular member for pumping fluid from the second tubular member to the surface; and (e) a sleeve positioned within the heel section of the inclined wellbore, the sleeve adapted to receive the plug member.

26. The artificial lift kit of claim 25, further comprising a swellable material for positioning to substantially prevent the egress of liquids between an inner surface of a casing and an outer surface of the plug member.

27. The artificial lift kit of claim 25, wherein the sleeve has a chamfered sealing surface and the plug member is swaged to mate with the chamfered sealing surface to effect a seal.

28. The artificial lift kit of claim 25, further comprising a particulate filter for positioning adjacent the first end of the second tubular member.

29. The artificial lift kit of claim 25, wherein the first end of the second tubular member is perforated for the intake of liquids.

30. The artificial lift kit of claim 25, wherein the pump is an electric submersible pump.

31. The artificial lift kit of claim 25, further comprising a seat for placement within the second tubular configured to permit the pumping means to be stabbed in and removed.

* * * * *